United States Patent [19]

Funayama

[11] Patent Number: 4,982,690

[45] Date of Patent: Jan. 8, 1991

[54] DEVELOPING DEVICE WITH MAGNETIC SUPPLY SEALS

[75] Inventor: Naotaka Funayama, Nara, Japan

[73] Assignee: Sharp Kabushiki Kaisha, Osaka, Japan

[21] Appl. No.: 248,774

[22] Filed: Sep. 23, 1988

[30] Foreign Application Priority Data

Oct. 9, 1987 [JP] Japan ..... 62-155127[U]

[51] Int. Cl.[5] ..... G03G 15/09

[52] U.S. Cl. ..... 118/657; 355/253

[58] Field of Search ..... 355/245, 251, 253, 260; 118/657, 658

[56] References Cited

U.S. PATENT DOCUMENTS 4,342,282 8/1982 Yamashita et al. ..... 118/657

4,652,115 3/1987 Palm et al. .

FOREIGN PATENT DOCUMENTS 56-102875 8/1981 Japan ..... 118/658

58-34468 2/1983 Japan ..... 355/245

59-195257 11/1984 Japan ..... 355/253

60-221780 11/1985 Japan ..... 355/260

61-3152 1/1986 Japan ..... 355/251

*Primary Examiner*—R. L. Moses

*Attorney, Agent, or Firm*—Flehr, Hohbach, Test, Albritton & Herbert

[57] ABSTRACT

A developing device has inside a developer tank a developer magnet roller for supplying developing agent to a photoreceptor, a screening member for preventing the supply of developing agent to this developer magnet roller, and sealing members made of magnets for sealing gaps formed around this screening member.

4 Claims, 5 Drawing Sheets

DEVELOPING DEVICE WITH MAGNETIC SUPPLY SEALS

BACKGROUND OF THE INVENTION

This invention relates to a developing device for an electrophotographic apparatus such as a copier and a laser printer.

A developing device for a color copier which forms a background of the present invention is shown in FIG. 4 wherein numeral 1 indicates a developer tank inside which developing agent is circulated along the dotted line with arrows around two stirrer rollers 2 and 3, a developer roller 4 which is a magnet roller, and a developing agent transporting roller 5 which is another magnet roller while toner in the developing agent is supplied to a photoreceptor (not shown) by the developer roller 4 through an opening 1*a* provided at the bottom of the developer tank. Surrounding the stirrer roller 3 is a cylindrical screening member 6 with openings 6*a* and 6*b* along portions of its circumference. This screening member 6 which is disposed rotatably with respect to the stirrer roller 3 such that the developing agent can be circulated freely during a development period as shown in FIG. 4 but that its flow from the stirrer roller 3 to the developer roller 4 can be interrupted as shown in FIG. 5 with the screening member 6 rotated by approximately 90° from the position shown in FIG. 4 when the developing device is not being used for development. A partitioning member 7 is placed between the stirrer roller 3 and the transporting magnet roller 5. Both the partitioning member 7 and the developer tank 1 are provided with a sealing member 8 made of an elastic material in contact with the screening member 6 for preventing the developing agent from leaking through the gaps between the screening member 6 and the partitioning member 7 and between the screening member 6 and the developer tank 1.

With a developing device thus structured, a strong driving force is required to rotate the screening member 6 because the sealing members 8 are in contact with it. There is also the possibility of the sealing members 8 becoming pulled into the gaps between the screening member 6 and the partitioning member 7 or between the screening member 6 and the developer tank 1, preventing the rotation of the screening member 6. Without the sealing members 8, on the other hand, stains may result on the photoreceptor since developing agent remains on the transportation magnet roller 5 even when developing is not taking place.

SUMMARY OF THE INVENTION

It is therefore an object of the present invention to eliminate the aforementioned problems. A developing device with which the above and other objects of the present invention may be achieved is characterized not only as including inside its developing tank a developer magnet roller for supplying developing agent to the photoreceptor and a screening member for preventing supply of developing agent to this developer magnet roller and sealing members for sealing the gaps around this screening member but also as having these sealing members formed with magnets.

With a developing device this structured with sealing members formed with magnets, development agent is adsorbed onto them at these gaps around the screening member. These gaps are therefore blocked by the adsorbed particles of the developing agent and these particles are prevented from leaking through them. Thus, these sealing members made of magnets need not be in contact with the screening member and hence do not increase the load of the driving means therefor.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1:
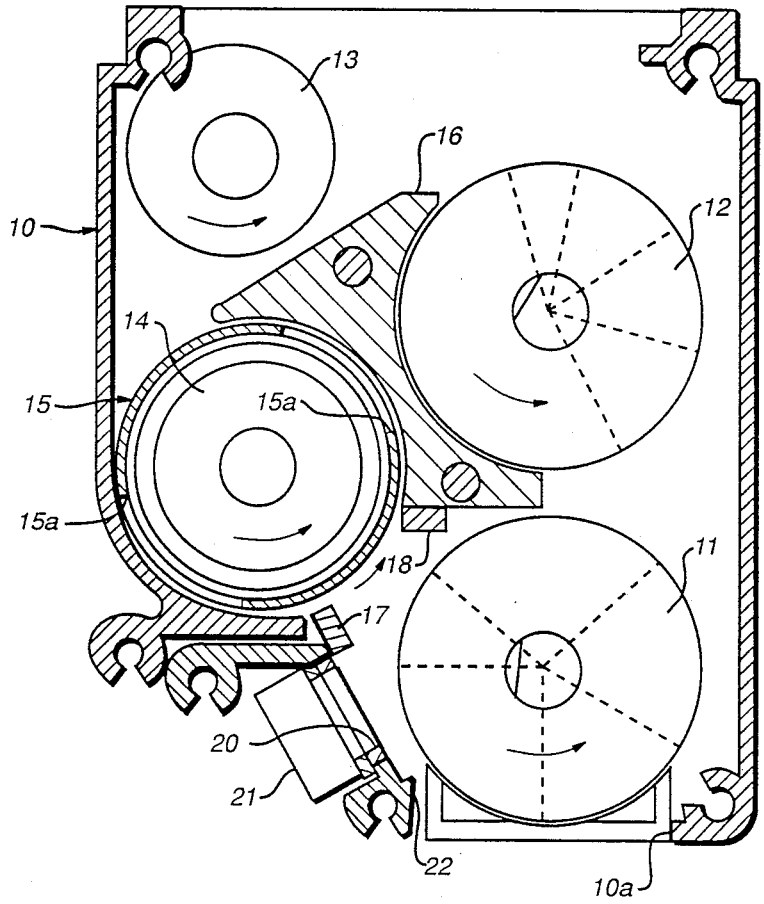
FIG. 1 is a sectional view of a developing device embodying the present invention when development is taking place.

As shown in FIG. 1, a developing device embodying the present invention for an electrophotographic apparatus such as a color copier comprises a developer tank 10 inside which a developer magnet roller 11 is disposed adjacent an opening 10*a* provided at the bottom of the tank 10. During a developing process, a developing agent composed of iron particles and toner is delivered to this developer magnet roller 11 and its toner component is thereby supplied to the photoreceptor (not shown) through the opening 10*a*.

Above the developer magnet roller 11 is disposed a developing agent transporting magnet roller 12, diagonally above which is disposed a first stirrer roller 13. A second stirrer roller 14 is disposed below the first stirrer roller 13. These stirrer rollers 13 and 14 are supported rotatably in the directions indicated by arrows drawn thereon.

A cylindrical screening member 15 with openings 15*a* on its circumference is provided around the second stirrer roller 14. This screening member 15 is rotatable with respect to the second stirrer roller 14. A partitioning member 16 is disposed between this cylindrical screening member 15 and the transportation magnet roller 12.

Sealing members 17 and 18 made of permanent magnets are attached to parts of the developer tank 10 and the partitioning member 16 facing the cylindrical screening member 15 and the developer magnet roller 11 so as not to touch the cylindrical screening member 15. These sealing members 17 and 18 serve to block the gaps formed around the screening member 15, that is, the gap between the screening member 15 and the partitioning member 16 and that between the screening member 15 and the developer tank 10 by adsorbing particles of the developing agent to form a brush-like shape such that the developing agent is prevented from leaking through these gaps.

Figure 2A:
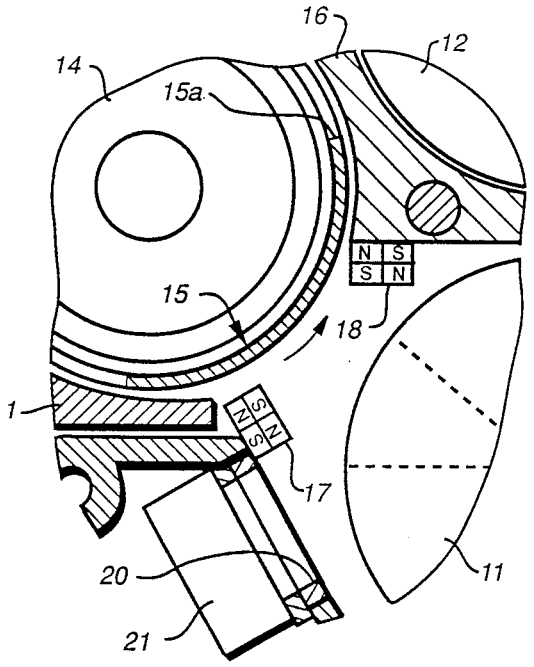
FIGS. 2A, 2B and 2C are enlargements of a part of FIG. 1, showing different pole arrangements of the magnets of the sealing members.
Figure 2B:
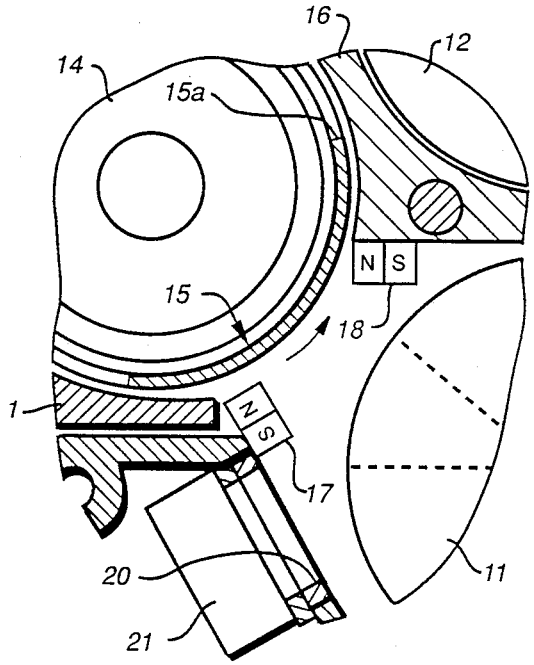
Figure 2C:
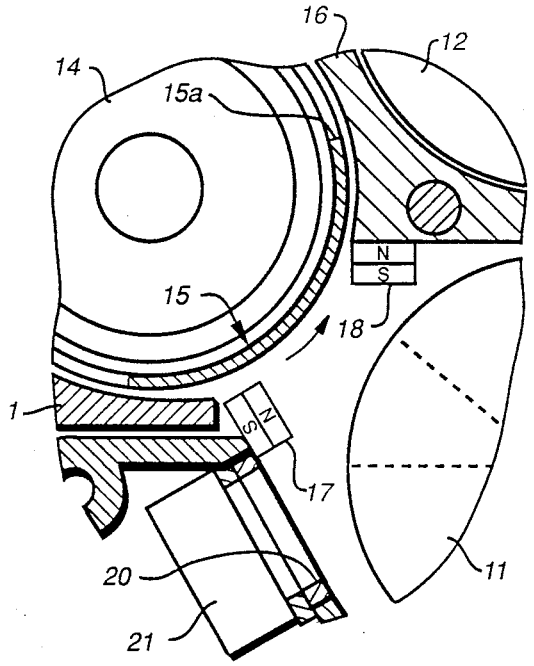

According to the embodiment of the present invention shown in FIG. 2A, the sealing members 17 and 18 are formed with N and S poles in a diagonally crossed formation. The embodiment of the present invention shown in FIG. 2B is characterized as having the N and S poles of the sealing members 17 and 18 arranged approximately in the direction in which developing agent is projected from the screening member 15. The embodiment of the present invention shown in FIG. 2C is characterized as having the N and S poles of the sealing members 17 and 18 arranged approximately in tangential directions of the screening member 15.

In these figures, numeral 20 indicates another opening provided to the developing tank 10 below the sealing member 17. A toner concentration sensor 21 for detecting the concentration of toner in the developing agent is attached to the developer tank 10 so as to block this opening 20. Numeral 22 indicates a doctor blade provided near the bottom opening 10*a* of the developer tank 10 for controlling the amount of developing agent supplied to the developer magnet roller 11.

With a developing device thus structured according to the present invention, the screening member 15 is so positioned as shown in FIG. 1 when developing is not taking place such that the flow of developing agent is prevented both from the first stirrer roller 13 to the second stirrer roller 14 and from the second stirrer roller 15 to the developer magnet roller 11.

Although the developing agent on the developer magnet roller 11 is transported to the first stirrer roller 13 by the operation of the transporting magnet roller 12, its flow to the second stirrer roller 14 is prevented by the screening member 15 and a part of the developing agent is accumulated around the first stirrer roller 13 and another part stays inside the screening member 15. In other words, there is no developing agent remaining around the developer magnet roller 11 when developing is not taking place. The developing agent is also prevented by the sealing members 17 and 18 made of magnets from leaking through the gaps around the screening member 15.

When developing is taking place, the screening member 15 is rotated approximately by 90° from the position shown in FIG. 1 such that the developing agent is permitted to flow through the openings 15*a* from the first stirrer roller 13 to the second stirrer roller 14 and from the second stirrer roller 14 to the developer magnet roller 11. Thus, developing agent is circulated inside the developer tank 10 from the first stirrer roller 13 to the second stirrer roller 14 to the developer magnet roller 11 to the transporting magnet roller 12 and back to the first stirrer roller 13 while toner is supplied through the bottom opening 10*a* from the developer magnet roller 11 to the photoreceptor.

Figure 3:
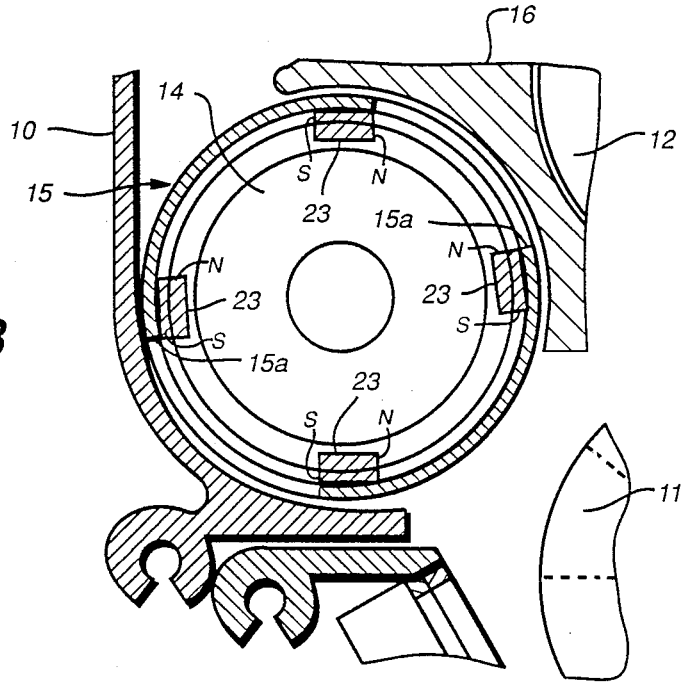
FIG. 3 is a sectional view of another developing device embodying the present invention.
Figure 4:
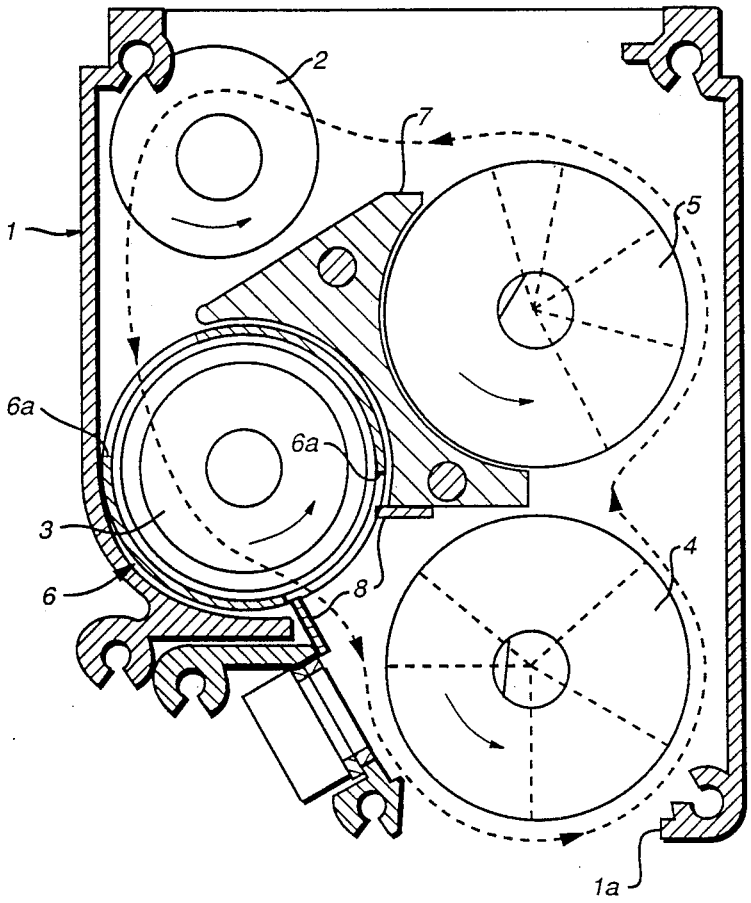
FIG. 4 (PRIOR ART)
FIG. 4 is a sectional view of a prior art developing device when development is taking place.
Figure 5:
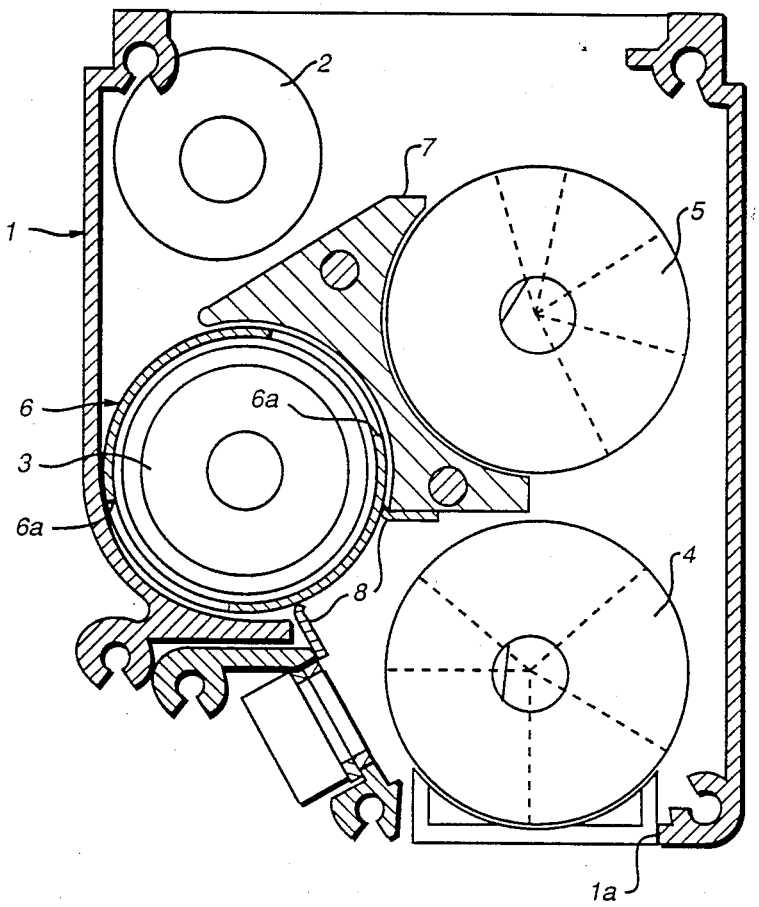
FIG. 5 (PRIOR ART)
FIG. 5 is a sectional view of the development device of FIG. 4 when development is not taking place.

Another developing device embodying the present invention is illustrated in FIG. 3 wherein components which are substantially identical to those already explained by way of FIG. 1 are indicated by the same numerals. This developing device is characterized as having sealing members 23 attached to the interior surface of the hollow cylindrical screening member 15 adjacent its openings 15*a* so as to prevent the developing agent from leaking through the gaps around the screening member 15 next to the partitioning member 16 and the developer tank 10.

In summary, developing devices of the present invention are characterized not only as having a screening member for interrupting the flow of developing agent to the developer magnet roller when developing is not taking place and sealing members for preventing the developing agent from leaking through the gaps formed around this screening member but also as having these sealing members formed with permanent magnets such that the sealing members do not have to be in contact with the screening member and hence problems associated with having the sealing members in contact with the screening member can be eliminated.

The foregoing description of preferred embodiments of the present invention has been presented for purposes of illustration and description. It is not intended to be exhaustive or to limit the invention to the precise form disclosed and many modifications and variations are possible in light of the above teaching. Such modifications and variations that may be apparent to a person skilled in the art are intended to be included within the scope of this invention.

I claim:

1. In a developing device comprising a developer tank containing therein a developer magnet roller for supplying developing agent to a photoreceptor, a screening member for preventing the supply of developing agent to said developer magnet roller, a partitioning member disposed opposite said screening member and sealing members for sealing gaps formed around said screening member with said tank and with said partitioning member, the improvement wherein said sealing members are affixed to said screening member and comprise magnets.

2. The developing device of claim 1 wherein said sealing members are disposed in non-contacting relationship with said screening member.

3. In a developing device comprising a developer tank containing therein a developer magnet roller for supplying developing agent to a photoreceptor, a screening member for preventing the supply of developing agent to said developer magnet roller, and sealing members for sealing gaps formed around said screening member, the improvement wherein said screening device is a hollow cylinder with openings and said sealing members comprise magnets and are affixed to the inner surface of said hollow cylinder adjacent to said openings.

4. In a developing device comprising a developer tank containing therein a developer magnet roller for supplying developing agent to a photoreceptor, a screening member for preventing the supply of developing agent to said developer magnet roller, a partitioning member disposed opposite said screening member and sealing members for sealing gaps formed around said screening member with said tank and with said partitioning member, the improvement wherein said screening device is a hollow cylinder with openings and said sealing members comprise magnets and are affixed to the inner surface of said hollow cylinder adjacent to said openings.

* * * * *